US011738838B1

(12) United States Patent
Matko

(10) Patent No.: US 11,738,838 B1
(45) Date of Patent: Aug. 29, 2023

(54) BUOYANCY COMPENSATOR BLADDER SUITABLE FOR BOTH BACK MOUNT AND SIDE MOUNT DIVING

(71) Applicant: Szabolcs Matko, Debrecen (HU)

(72) Inventor: Szabolcs Matko, Debrecen (HU)

( * ) Notice: Subject to any disclaimer, the term of this patent is extended or adjusted under 35 U.S.C. 154(b) by 0 days.

(21) Appl. No.: 17/583,413

(22) Filed: Jan. 25, 2022

(51) Int. Cl.
*B63C 11/24* (2006.01)
*B63C 11/02* (2006.01)
*B63C 11/08* (2006.01)

(52) U.S. Cl.
CPC ..... *B63C 11/08* (2013.01); *B63C 2011/026* (2013.01)

(58) Field of Classification Search
CPC ..... B63C 11/08; B63C 2011/026; B63C 11/2245; B63C 2011/085; B63C 11/24; B63C 9/1255; B63C 11/02; B63C 11/30; B63C 11/46; B63C 2011/027; B63C 2011/303
See application file for complete search history.

(56) References Cited

U.S. PATENT DOCUMENTS 3,035,747 A * 5/1962 Ullrich, Jr. ..... B63C 11/30 224/265
3,065,888 A * 11/1962 Lande ..... B63C 11/02 224/604
3,820,348 A * 6/1974 Fast ..... B63C 11/2245 441/96
3,866,253 A * 2/1975 Sinks ..... B63C 11/2245 128/202.14
3,877,098 A 4/1975 Braly
4,137,585 A * 2/1979 Wright, III ..... B63C 11/2245 128/204.26
4,176,418 A * 12/1979 Scott ..... B63C 11/08 128/204.26
4,227,521 A * 10/1980 Hart ..... B63C 11/2227 128/204.26
D289,672 S * 5/1987 Pritchard ..... D24/110.5
4,681,552 A * 7/1987 Courtney ..... B63C 11/2245 441/115
4,690,314 A * 9/1987 Faulconer ..... B63C 11/08 224/628
4,752,263 A * 6/1988 Pritchard ..... B63C 11/02 128/202.14
4,778,307 A * 10/1988 Faulconer ..... B63C 11/08 441/106

(Continued)

*Primary Examiner* — Edwin J Toledo-Duran
(74) *Attorney, Agent, or Firm* — SANCHELIMA & ASSOCIATES, P.A.; Christian Sanchelima; Jesus Sanchelima

(57) ABSTRACT

A buoyancy compensator bladder includes an air cell, a connector, a low-pressure inflator (LPI), and at least one over pressure valve. The LPI which inflates and deflates the air cell is positioned on an outer surface of the air cell. As a result, when the fully assembled buoyancy compensator is equipped by a diver, the LPI runs from behind the diver's torso and under their armpit. This results in the inflator head which is part of the LPI to be disposed on the front of the diver's chest during back mount or side mount diving. This structure allows the bladder to be easily used for either back mount or side mount diving. The bladder may further be equipped with auxiliary/non-essential devices such as wight pockets/pouches.

4 Claims, 10 Drawing Sheets

(56) References Cited

U.S. PATENT DOCUMENTS

| | | | | | |
|---|---|---|---|---|---|
| 4,779,554 | A * | 10/1988 | Courtney | B63C 9/1255 | 441/116 |
| 4,810,134 | A * | 3/1989 | Eaulconer | B63C 11/08 | 441/118 |
| 5,249,890 | A * | 10/1993 | Bergstrom | B63C 11/02 | 405/185 |
| 5,346,419 | A * | 9/1994 | Kaiser | B63C 11/08 | 441/96 |
| 5,378,084 | A * | 1/1995 | Walters | B63C 11/08 | 441/106 |
| 5,403,123 | A * | 4/1995 | Walters | B63C 11/04 | 405/186 |
| 5,516,233 | A * | 5/1996 | Courtney | B63C 11/02 | 441/106 |
| 5,522,679 | A * | 6/1996 | Eungard | B63C 11/08 | 441/108 |
| 5,620,282 | A * | 4/1997 | Stinton | B63C 11/08 | 441/106 |
| 5,662,433 | A | 9/1997 | Seligman | | |
| 5,855,454 | A * | 1/1999 | Courtney | B63C 9/1055 | 441/108 |
| 6,039,043 | A * | 3/2000 | Graber | B63C 11/2227 | 128/206.28 |
| 6,477,709 | B1 * | 11/2002 | Kawana | B63C 11/08 | 2/2.15 |
| 6,503,114 | B2 * | 1/2003 | Kawashima | A41D 13/012 | 441/116 |
| 6,666,622 | B1 * | 12/2003 | Courtney | B63C 11/30 | 441/115 |
| 8,834,069 | B1 * | 9/2014 | Harvey | B63C 11/08 | 137/505.46 |
| 2001/0036781 | A1 * | 11/2001 | Cressi | B63C 11/08 | 441/88 |

* cited by examiner

BUOYANCY COMPENSATOR BLADDER SUITABLE FOR BOTH BACK MOUNT AND SIDE MOUNT DIVING

BACKGROUND OF THE INVENTION

1. Field of the Invention

The present invention relates to a buoyancy compensator bladder and, more particularly, to a buoyancy compensator bladder that includes a low-pressure inflator suitably positioned for both back mount and side mount diving.

2. Description of the Related Art

Several designs for a buoyancy compensator bladder have been designed in the past. None of them, however, include a buoyancy compensator bladder with a low-pressure inflator (LPI) suitably positioned for both back mount and side mount diving configurations. The LPI which inflates and deflates the air cell is positioned on an outer surface of the air cell. As a result, when the fully assembled buoyancy compensator is equipped by a diver, the LPI runs from behind the diver's torso and under their armpit. This results in the inflator head which is part of the LPI to be disposed on the front of the diver's chest during back mount or side mount diving. This structure allows the bladder to be easily used for either back mount or side mount diving. It is known that divers often use back mount or side mount configurations when diving. Additionally, most buoyancy compensator bladders are currently designed to work exclusively for either back mount or side mount diving. Therefore, there is a need for a buoyancy compensator bladder that allows for the LPI to run under the diver's armpit for use of both back mount and side mount diving. This allows the present invention to adapt to a user's preferred method of diving.

Applicant believes that a related reference corresponds to U.S. Pat. No. 3,877,098 issued for a buoyancy pillow for a free diver that is attached to the ventral side of diver's trunk by shoulder, waist, and crotch straps. Applicant believes that another related reference corresponds to U.S. Pat. No. 5,662,433 issued for a combination spider and buoyancy compensator having a chest portion which include stretchable material to support the breasts of a diver. However, the cited references differ from the present invention because they fail to disclose a buoyancy compensator bladder with an LPI suitably positioned to run under the diver's armpit to allow for both back mount and side mount diving. The location of the LPI mounted provides a flexible configuration that adapts to a user's need based on preference when performing a diving task.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a buoyancy compensator bladder with an LPI that runs under diver's armpit when the bladder is used for back mount diving.

It is another object of the present invention to provide a buoyancy compensator bladder with an LPI that runs under the diver's armpit when the bladder is used for side mount diving.

It is another object of this invention to provide a buoyancy compensator bladder that does not need to be repositioned. Additionally, neither the bladder nor the buoyancy compensator has to be reconfigured when switching from back mount to side mount diving.

It is still another object of the present invention to provide a buoyancy compensator bladder that is versatile and easy to use.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
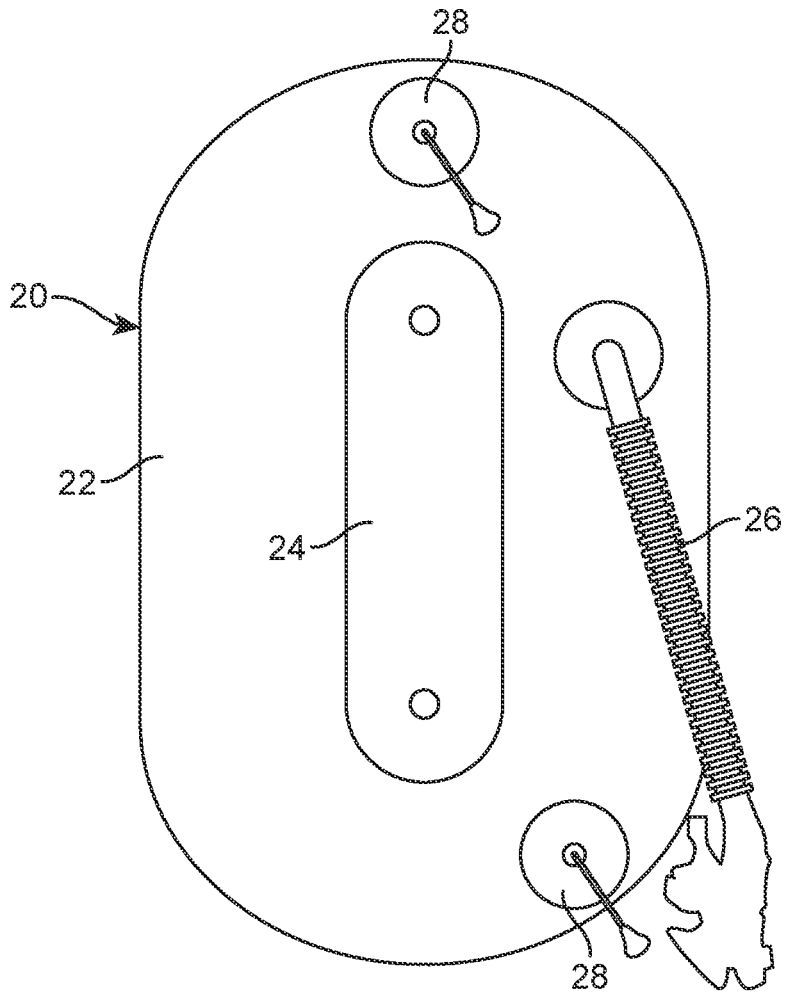
FIG. 1 represents a front view of bladder assembly 20 in accordance with an embodiment of the present invention.
Figure 2:
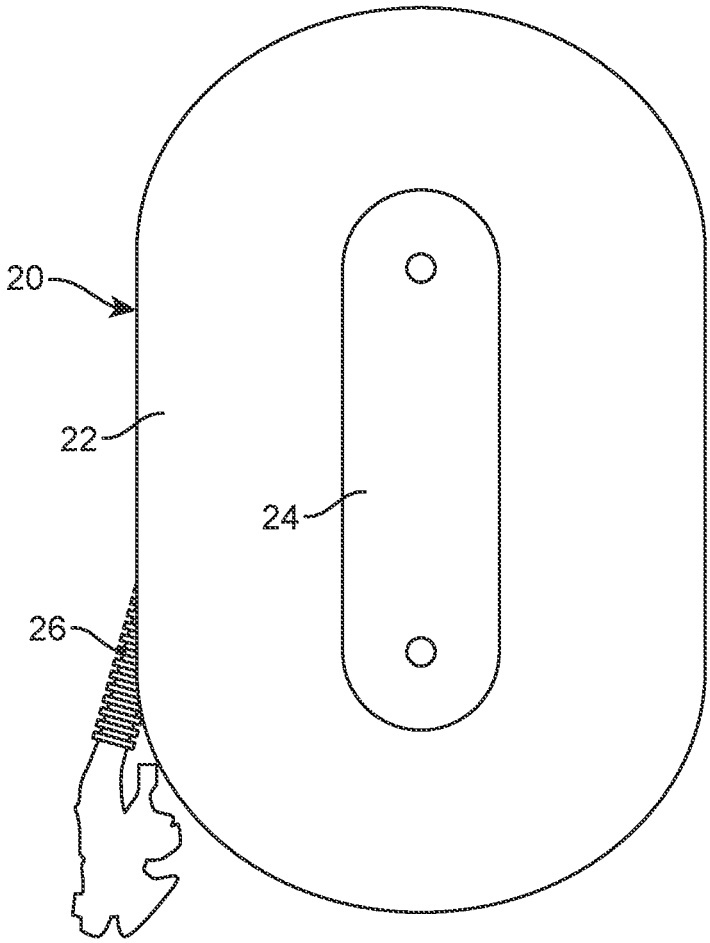
FIG. 2 shows a rear view of bladder assembly 20 in accordance with an embodiment of the present invention.

Referring now to the drawings, where the present invention is generally referred to with numeral 10, it can be observed a buoyancy compensator system 10 which basically includes a bladder assembly 20, a backplate assembly 40, and a cylinder adapter assembly 60.

Bladder assembly 20 includes an air cell 22. In one embodiment, air cell 22 has a substantially oval shape and includes a front side and a rear side. Air cell 22 is to be provided as a suitable air cell that is used in diving environments. Bladder assembly 20 further includes a connector 24 disposed along the center portion of air cell 22. In the present implementation, connector 24 is operatively connected to backplate assembly 40 and cylinder adapter assembly 60. Connector 24 may have an oval shape and may be secured to air cell 22 by means of stiches along the entire perimeter of connector 24. Connector 24 may include connector holes 24*a*. It should be understood that air cell 22 and connector 24 may have any other suitable shape different from the present embodiment.

Figure 5:
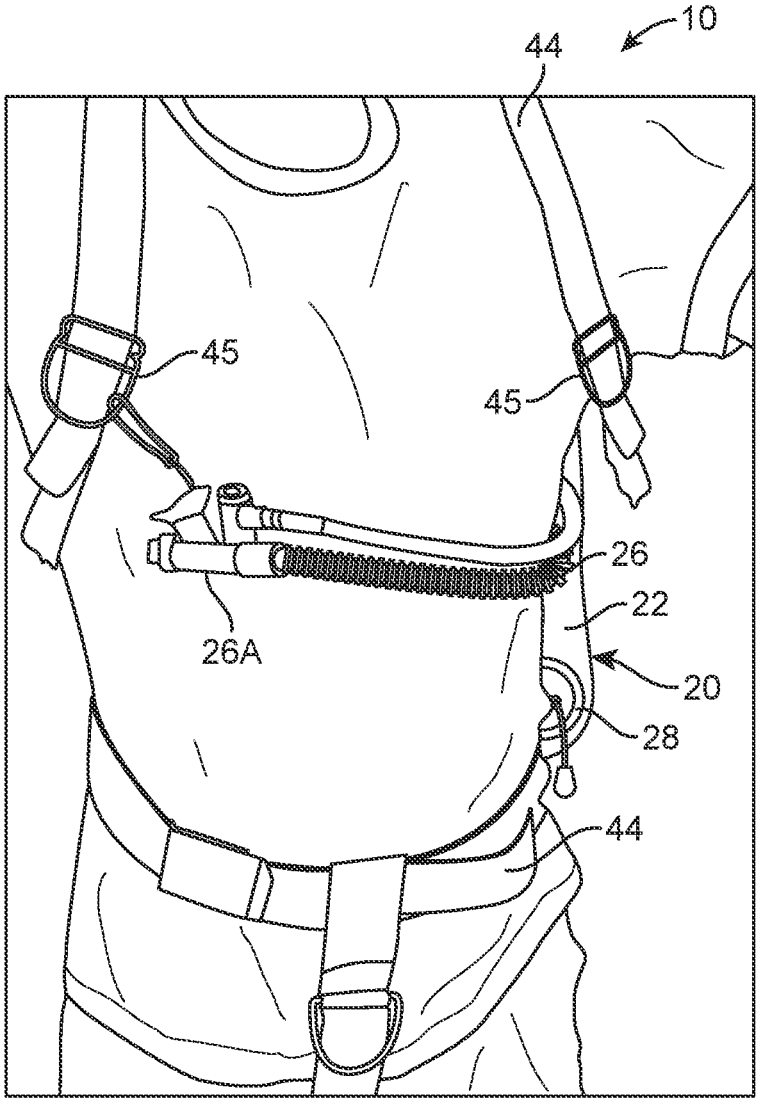
FIG. 5 shows a front view of buoyancy compensator system 10 mounted to a user in accordance with an embodiment of the present invention.
Figure 8:
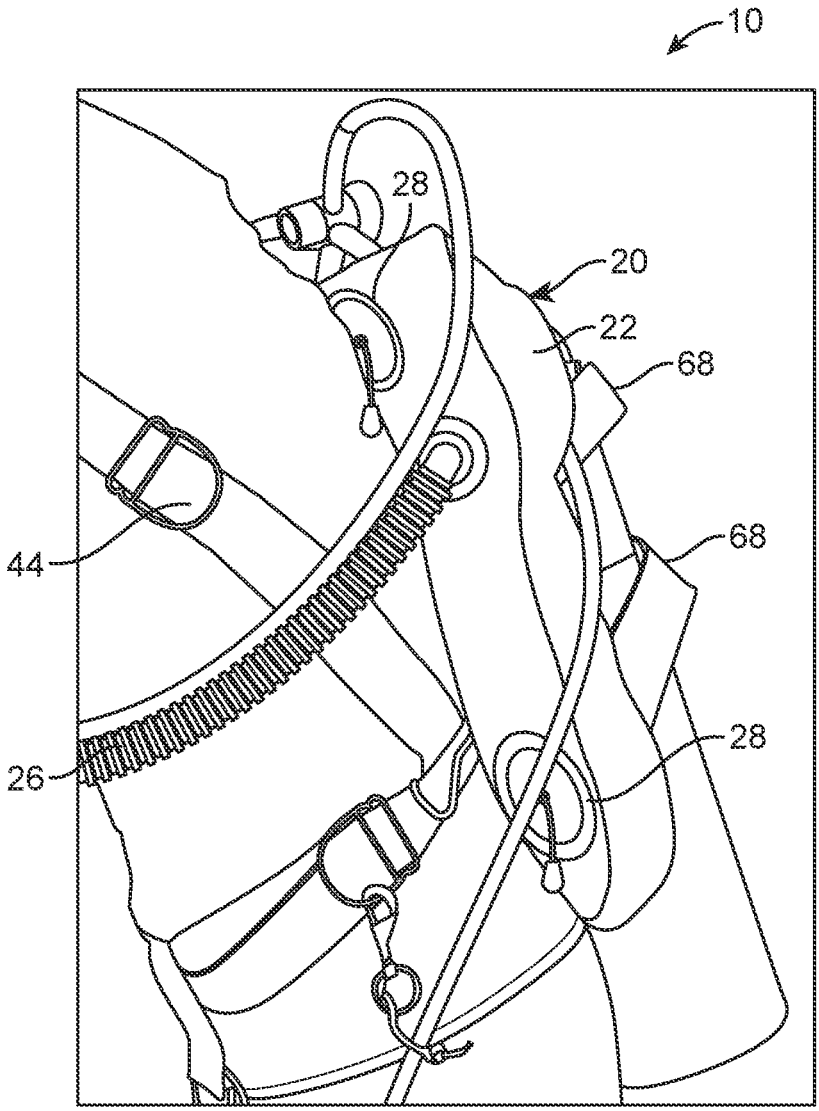
FIG. 8 shows an isometric side view of buoyancy compensator system 10 assembled in a rear mount configuration and mounted to a user in accordance with an embodiment of the present invention.
Figure 11:
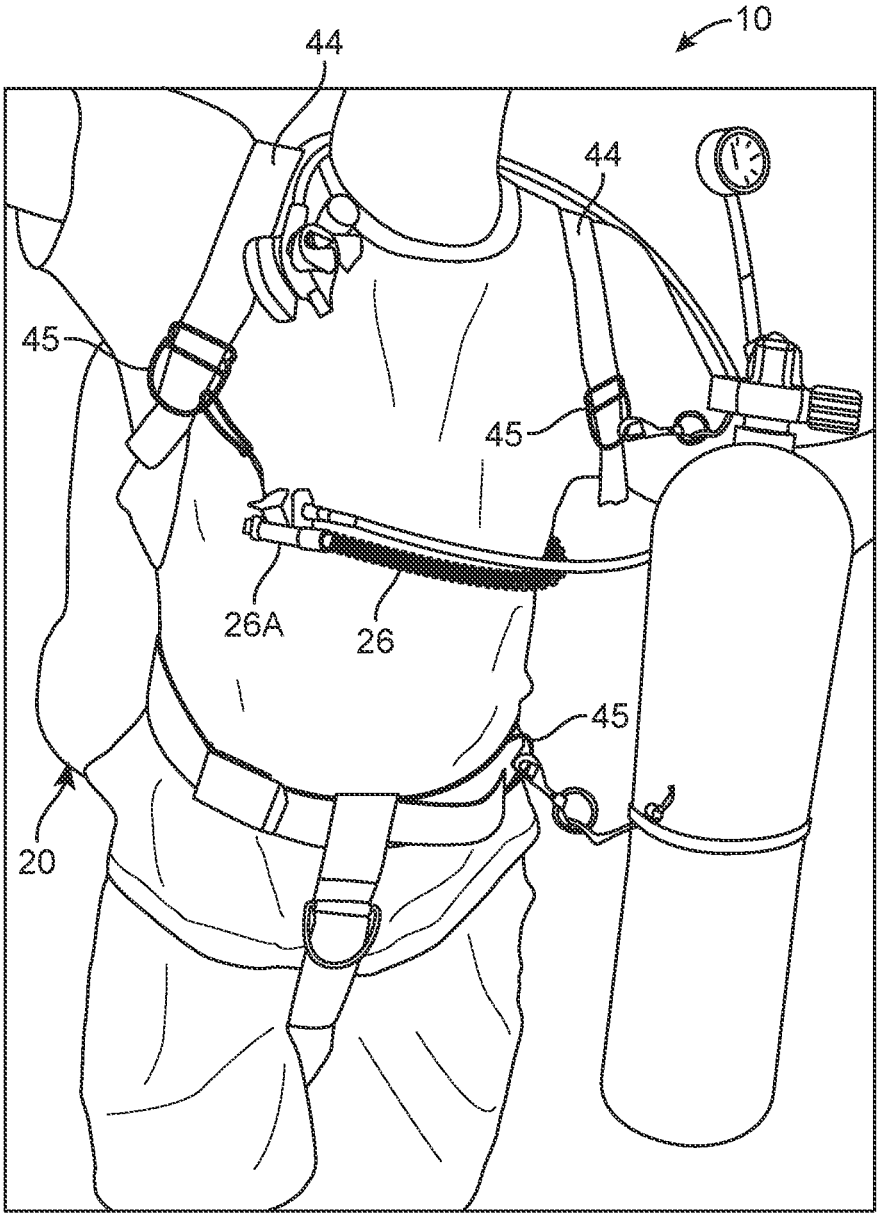
FIG. 11 shows an isometric side view of buoyancy compensator system 10 assembled in a side mount configuration and mounted to a user in accordance with an embodiment of the present invention.

Bladder assembly 20 further includes a low-pressure inflator (LPI) 26 secured on the exterior surface of the air cell. The location of LPI 26 is pertinent to the configuration of the present invention. Air cell 22 includes a top surface portion, a bottom surface portion, and a middle surface portion. In the present embodiment, LPI 26 is positioned along the middle surface portion of air cell 22 as observed in FIG. 1. The location of the LPI 26 allows for the present system to utilize both side mount and rear mount diving configurations. The positioning of LPI 26 allows for it to run underneath a user's armpit as observed in FIG. 5. FIGS. 8 and 11 depict a rear mount configuration and side mount configuration respectively. It can be observed that the present configuration allows for LPI 26 to run underneath the user's armpit regardless of which type of diving configuration is being utilized. In both configurations, the inflator head 26A can be attached to the harness' 44 shoulder D-ring 45 by means of a piece of bungee rope and a carabiner. As a result, the diver can easily reach to the inflator head 26A and operate it with either the left or right hand of a user.

Bladder assembly 20 further includes overpressure valve 28 disposed on the air cell 22. In the present embodiment depicted in FIG. 1, air cell 22 contains two overpressure valves 28. However, it should be understood that the present invention could be configured with at least one overpressure valve 28.

Backplate assembly 40 includes a backplate 42 and harness 44. Backplate 42 may be provided as a metal backplate that is coupled to air cell 22. Backplate 42 includes backplate holes 42*a*. Backplate 42 allows for air cell 22 to be engaged with a user's back. It should be understood that backplate 42 should have a size and shape that cooperates with the size and shape of connector 24 and cylinder adapter assembly 60. Furthermore, harness 44 includes a plurality of D-rings 45. Other additional structural elements may be implemented into the backplate assembly 40 such as a crotch strap and other common diving elements.

Figure 3:
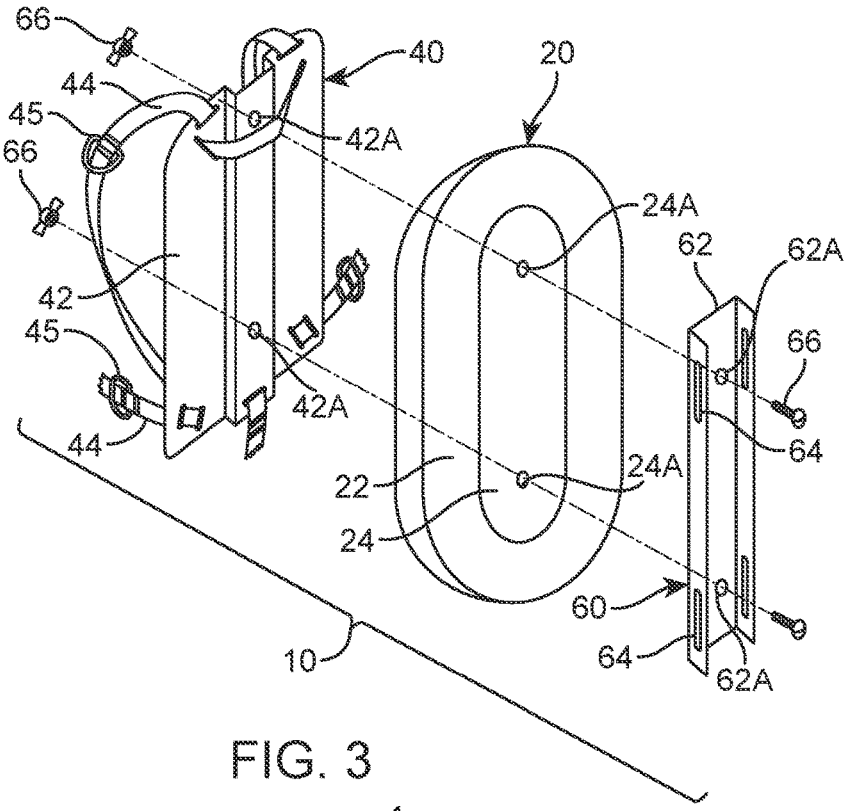
FIG. 3 illustrates an isometric exploded view of buoyancy compensator system 10 depicting bladder assembly 20, backplate assembly 40, and cylinder adapter assembly 60 in accordance with an embodiment of the present invention.
Figure 4:
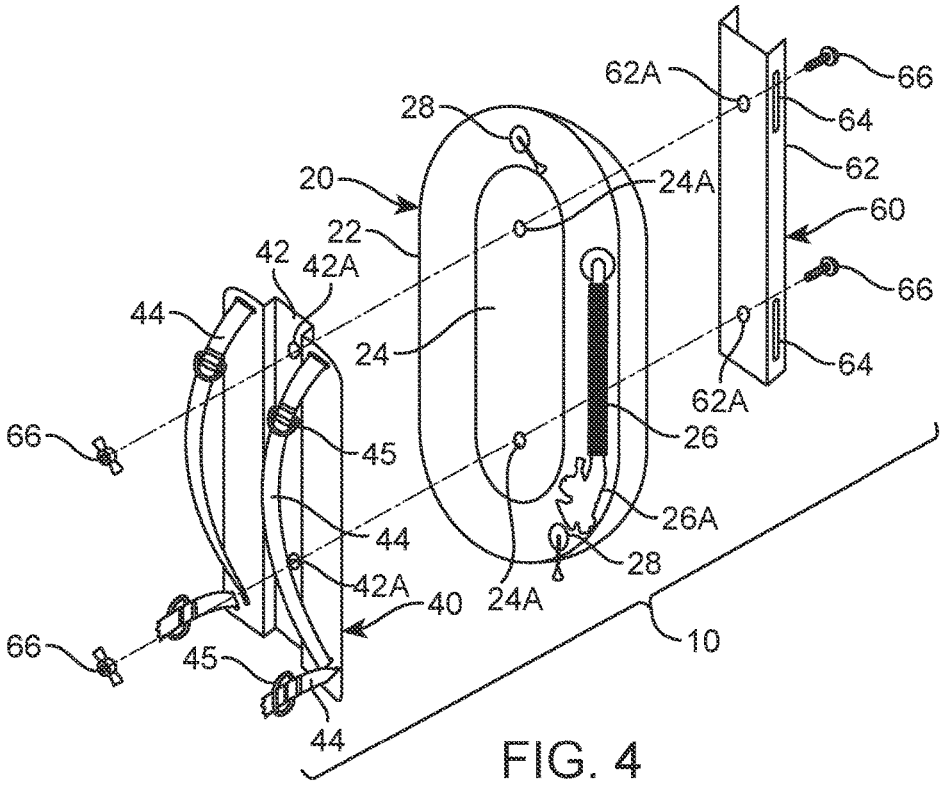
FIG. 4 is a representation of another isometric exploded view of buoyancy compensator system 10 depicting bladder assembly 20, backplate assembly 40, and cylinder adapter assembly 60 in accordance with an embodiment of the present invention.
Figure 7:
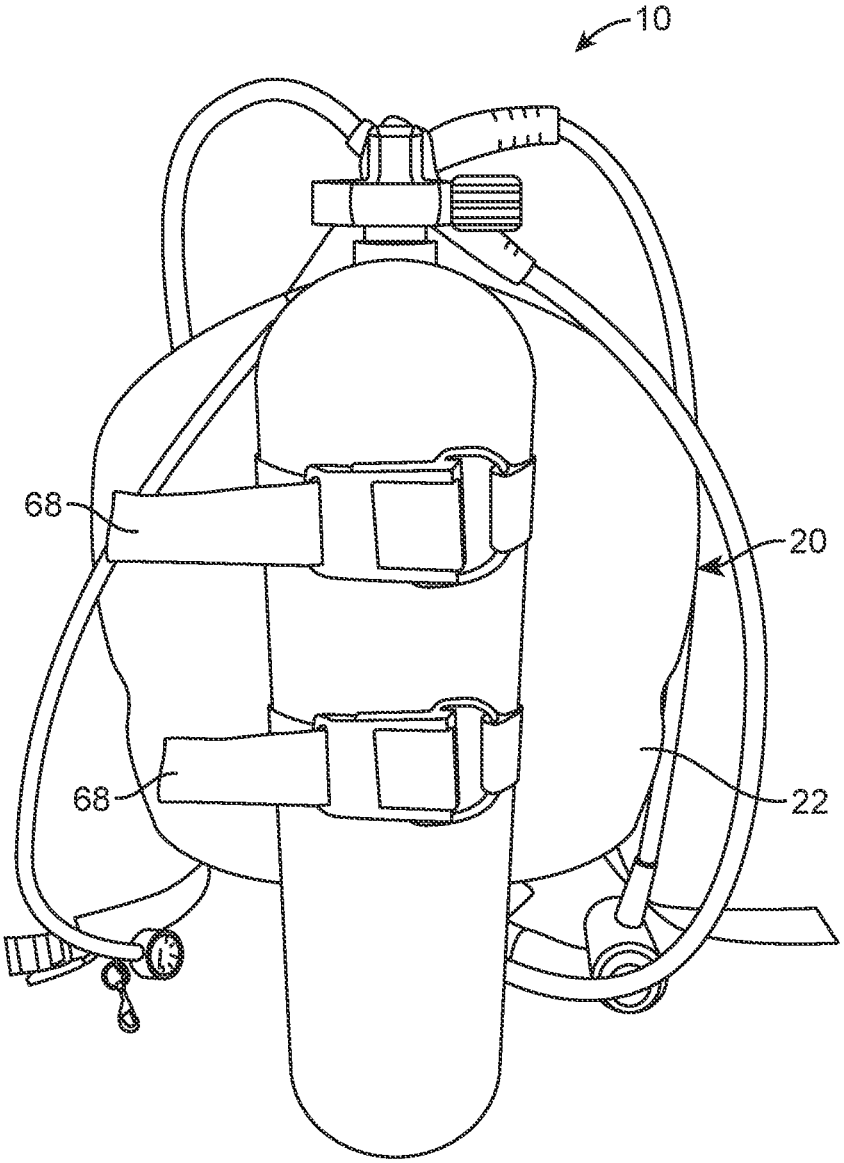
FIG. 7 represents a rear view of buoyancy compensator system 10 assembled in a rear mount configuration in accordance with an embodiment of the present invention.

Cylinder adapter assembly 60 includes an adapter member 62 that is coupled to air cell 22 as observed in FIGS. 3 and 4 of the drawings. Adapter member 62 is coupled with connector 24 of air cell 22 and is used to securely engage a diving cylinder to the present system. Adapter member 62 further includes vertical holes 64 which receive cam bands 68. Adapter member 62 may further include adapter member holes 62*a*. FIG. 7 depicts a diving cylinder securely mounted to the adapter member 62. Cain bands 68 are utilized to secure the cylinder to the adapter member 62 as depicted in the drawing. Cylinder adapter assembly 60 further includes fastening members 66 which engage with adapter member 62, air cell 22, and backplate 42 via backplate holes 42*a*, connector holes 24*a* and adapter member holes 62*a* as depicted in FIGS. 3 and 4 of the provided drawings. As a result, all the assemblies are engaged when the present system is assembled. It should be understood that different embodiments of the present invention may not include the cylinder adapter member 62.

Figure 6:
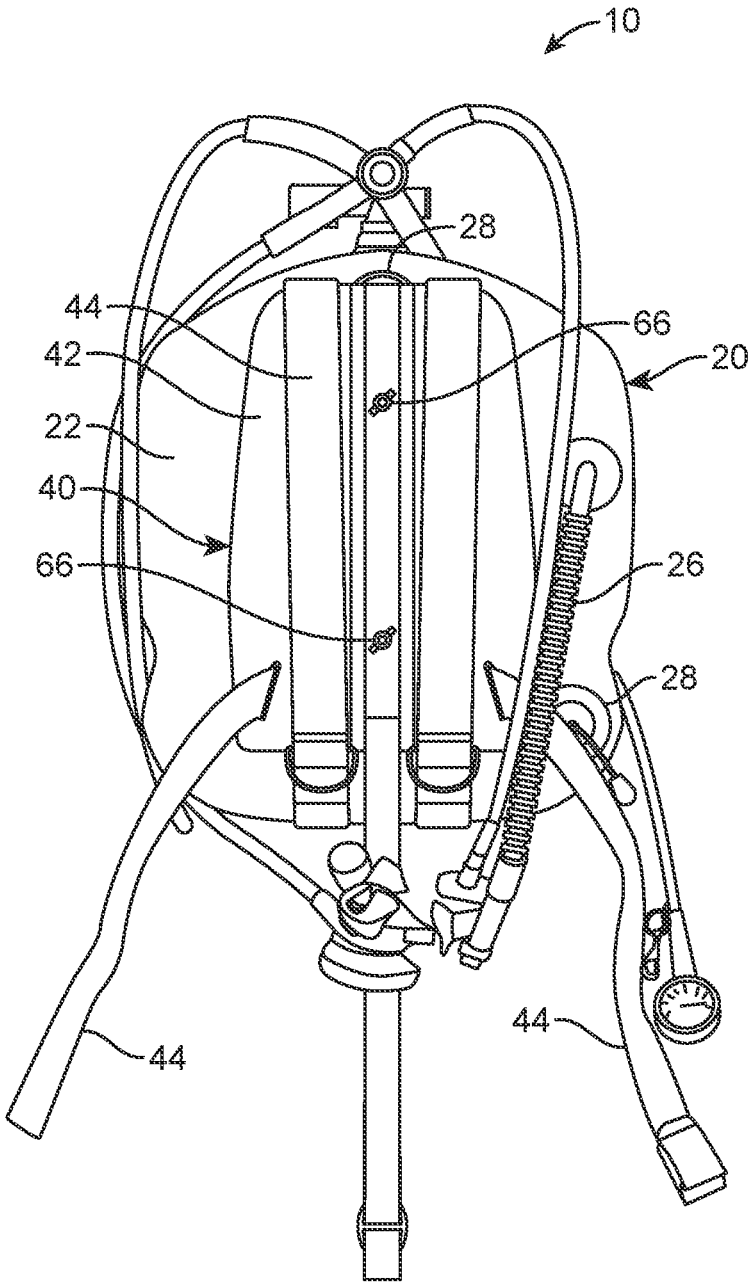
FIG. 6 illustrates a front view of buoyancy compensator system 10 assembled in a rear mount configuration in accordance with an embodiment of the present invention.
Figure 9:
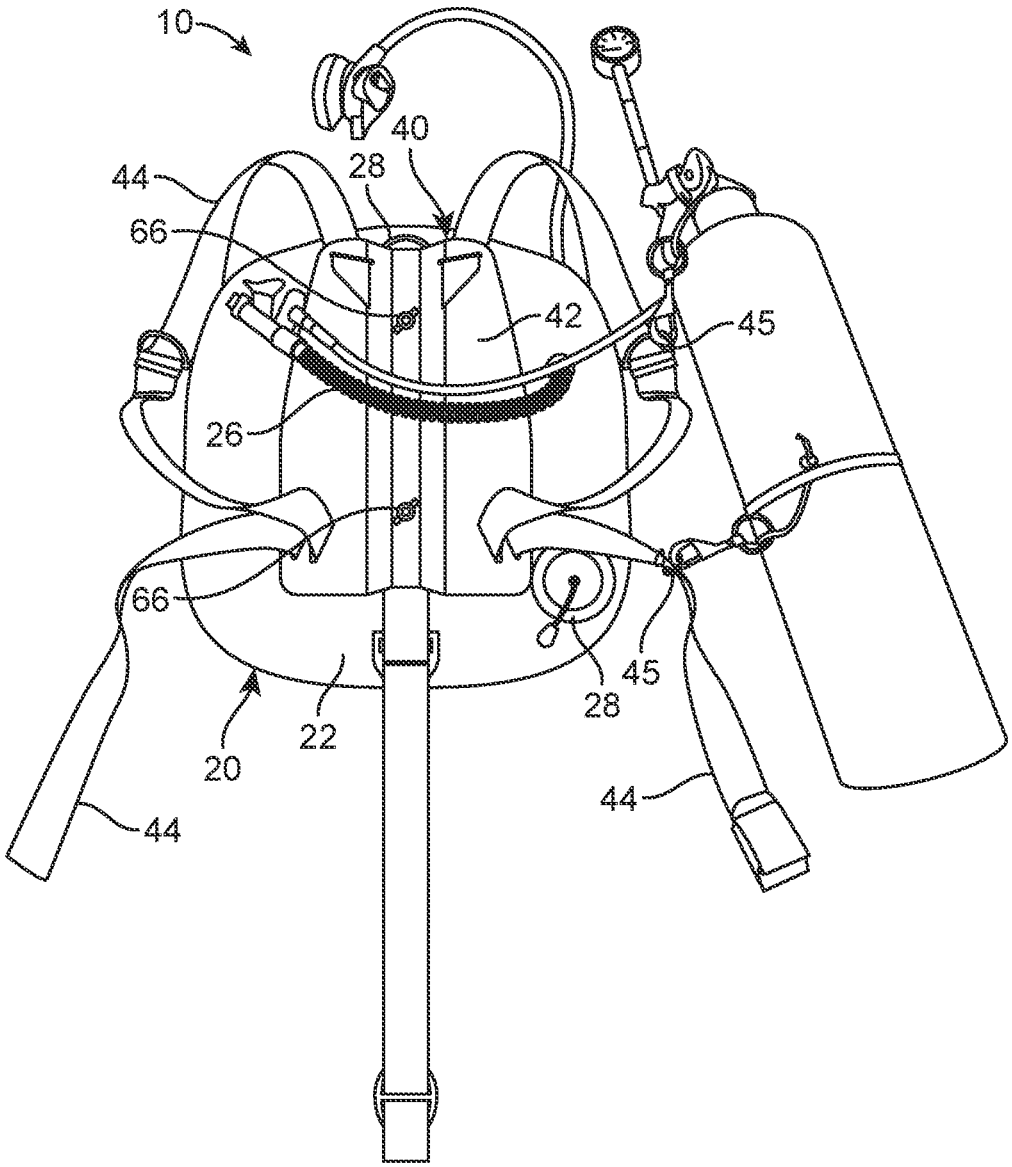
FIG. 9 illustrates a front view of buoyancy compensator system 10 assembled in a side mount configuration in accordance with an embodiment of the present invention.
Figure 10:
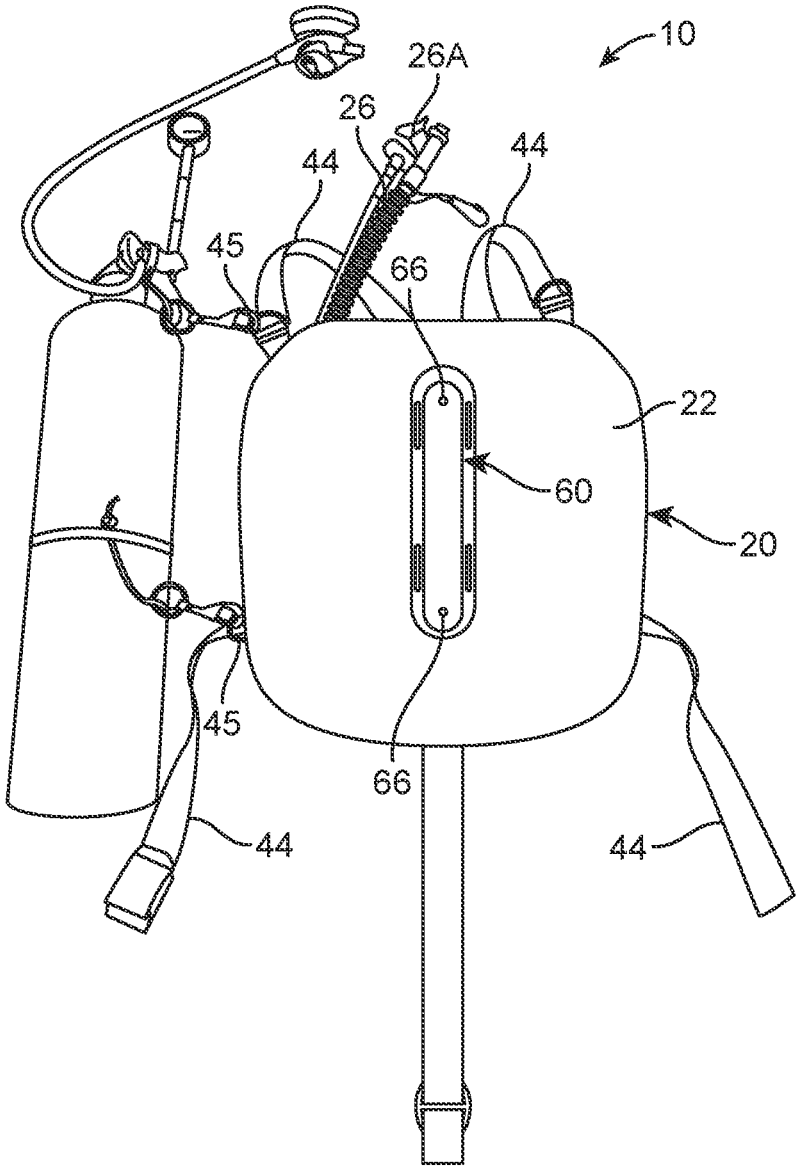
FIG. 10 is a representation of a rear view of buoyancy compensator system 10 assembled in a side mount configuration in accordance with an embodiment of the present invention.

FIGS. 6-8 depict the present system engaged in the rear mount configuration. It can be observed that cam bands 68 are used to secure the cylinder to the rear of the air cell 22 by means of the cylinder adapter assembly 60. However, it should be understood that the present invention could be configured with one cam band 68. The LPI 26 comfortably runs under the armpit of the user and the inflator head 26A comfortably sits at the front end of the user. FIGS. 9-11 depict the present system engaged in a side mount configuration. It can be observed that the cylinder is connected to two D-rings 45 located on the harness 44 with one D-ring 45 on the shoulder strap, and another D-ring 45 on the waist strap by means of two swivel rings with a single end bolt snap. The figures depict one cylinder mounted onto the system. However, it should be understood that two cylinders may be utilized for the side mount configuration. The LPI 26 then comfortably runs under the armpit of the user and the inflator head 26A sits at the front end of the user similar to the configuration of the rear mount diving. The present invention advantageously allows for a diver to use their preferred diving configuration without the need to change equipment to suit rear mount or side mount diving.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A buoyancy compensator system, comprising:

a) a bladder assembly including an air cell, wherein said air cell has an oval shape, wherein the air cell includes a first over pressure valve and a second over pressure valve, a connector and a low-pressure inflator mounted along a middle surface portion of said air cell, wherein said air cell includes a top surface portion and a bottom surface portion, wherein the low-pressure inflator is adapted to be positioned underneath an armpit of a user, wherein said connector is disposed on the middle surface portion of said air cell having a predetermined separation with edges of said air cell, wherein said connector includes connector holes, wherein said first over pressure valve is located on said top surface portion and said second over pressure valve is located on said bottom surface portion;

b) a cylinder adapter assembly receiving a cylinder to be coupled thereon, wherein said cylinder adapter assembly includes an adapter member, wherein said adapter member has a rectangular elongated shape having a front wall and sidewalls, wherein said sidewalls have vertical holes extending about a length thereof, wherein said vertical holes are adapted to receive cam bands, wherein said adapter member is capable of be used to receive said cylinder, wherein said front wall includes adapter member holes, wherein said adapter member is removably attached to a rear end of said connector; and c) a backplate assembly, wherein said backplate assembly includes a backplate being coupled with the connector of the air cell at a front face thereof, wherein said backplate has a rectangular shape with top rounded corners and a central channel disposed at a central portion thereof, wherein said central channel extends a length of said backplate, said central channel having a rear wall and sidewalls, wherein said rear wall of said channel includes backplate holes, wherein said backplate assembly includes fastening members, wherein said fastening members are introduced through said backplate holes, said connector holes and said adapter member holes to attach together said adapter member, said air cell and said backplate, wherein said backplate includes harness, wherein said harness are configured to secure said backplate to the user, wherein said harness include a first set of harness and a second set of harness, wherein said first set of harness extend vertically from a top portion of said backplate to a bottom portion of said backplate, wherein said second set of harness extend horizontally from a right-bottom portion of said backplate to a left-bottom portion of said backplate, wherein said harness include a plurality of D-rings therein.

2. The buoyancy compensator system of claim 1 wherein the low-pressure inflator further includes an inflator head.

3. The buoyancy compensator system of claim 1 wherein the cylinder is coupled to said cylinder adapter assembly using said cam bands.

4. A buoyancy compensator system, consisting of:

a) a bladder assembly including an air cell, wherein said air cell has an oval shape, wherein the air cell includes a first over pressure valve and a second over pressure valve, a connector and a low-pressure inflator mounted along a middle surface portion of said air cell, wherein said air cell includes a top surface portion and a bottom surface portion, wherein the low-pressure inflator is adapted to be positioned underneath an armpit of a user, wherein said connector is disposed on the middle surface portion of said air cell having a predetermined separation with edges of said air cell, wherein said connector includes connector holes, said connector holes transversely go through said connector, wherein said first over pressure valve is located on said top surface portion and said second over pressure valve is located on said bottom surface portion;

b) a cylinder adapter assembly receiving a cylinder to be coupled thereon, wherein said cylinder adapter assembly includes an adapter member, wherein said adapter member has a rectangular elongated shape having a front wall and sidewalls, wherein said sidewalls have vertical holes extending about a length thereof, wherein said vertical holes are adapted to receive cam bands, wherein said adapter member is capable of be used to receive said cylinder in abutting contact with said sidewalls and a rear side of said front wall of said adapter member, wherein said front wall includes adapter member holes, wherein said adapter member is removably attached to a rear end of said connector, wherein said cam bands are introduced within said vertical holes to secure said cylinder to said adapter member; and c) a backplate assembly, wherein said backplate assembly includes a backplate being coupled with the connector of the air cell at a front face thereof, wherein said backplate has a rectangular shape with top rounded corners and a central channel disposed at a central portion thereof, wherein said backplate is a metallic backplate, wherein said central channel extends a length of said backplate, said central channel having a rear wall and sidewalls, wherein said rear wall of said channel includes backplate holes, wherein said backplate assembly includes fastening members, wherein said fastening members are introduced through said backplate holes, said connector holes and said adapter member holes to attach together said adapter member, said air cell and said backplate, wherein said backplate holes said connector holes and said adapter member holes are colinear therebetween, wherein each of said fastening members include a male member and a female member, wherein said male member is threadably coupled with said female member, wherein said backplate includes harness, wherein said harness are configured to secure said backplate to the user, wherein said harness include a first set of harness and a second set of harness, wherein said first set of harness extend vertically from a top portion of said backplate to a bottom portion of said backplate, wherein said second set of harness extend horizontally from a right-bottom portion of said backplate to a left-bottom portion of said backplate, wherein said harness include a plurality of D-rings therein, wherein said buoyancy compensator system includes a side mounting configuration and a rear mounting configuration, wherein said cylinder is mounted on said adapter member in said rear mounting configuration, said cylinder is mounted hanging from said harness by means of single end bolt snaps which are engaged with said D-rings.

* * * * *